US009161671B2

(12) United States Patent
Vitucci-Schneider

(10) Patent No.: US 9,161,671 B2
(45) Date of Patent: Oct. 20, 2015

(54) SPONGE WITH ONE OR MORE SURFACE OPENINGS

(71) Applicant: Christine Vitucci-Schneider, Bartlett, IL (US)

(72) Inventor: Christine Vitucci-Schneider, Bartlett, IL (US)

( * ) Notice: Subject to any disclaimer, the term of this patent is extended or adjusted under 35 U.S.C. 154(b) by 0 days.

(21) Appl. No.: 13/827,598

(22) Filed: Mar. 14, 2013

(65) Prior Publication Data

US 2014/0259502 A1 Sep. 18, 2014

(51) Int. Cl.
*A47L 13/16* (2006.01)

(52) U.S. Cl.
CPC ..... *A47L 13/16* (2013.01)

(58) Field of Classification Search
CPC ..... A47L 13/10; A47L 13/16; A47L 13/17
USPC ..... 15/104.93, 104.94, 244.1, 244.3, 244.4; D32/40, 52
See application file for complete search history.

(56) References Cited

U.S. PATENT DOCUMENTS

| | | | | |
|---|---|---|---|---|
| 2,030,911 | A | 2/1936 | Borden | |
| 2,319,873 | A * | 5/1943 | Linz | 15/244.4 |
| 3,090,985 | A * | 5/1963 | Baum | 15/244.1 |
| 3,972,325 | A | 8/1976 | Bluestone | |
| 4,077,083 | A * | 3/1978 | Siemund et al. | 15/244.1 |
| 4,282,891 | A | 8/1981 | Duceppe | |
| 4,446,965 | A | 5/1984 | Montiel | |
| 4,627,129 | A * | 12/1986 | Wittes | 15/244.4 |
| 4,671,306 | A | 6/1987 | Spector | |
| 4,866,806 | A | 9/1989 | Bedford | |
| 4,964,372 | A | 10/1990 | Zeenni et al. | |
| 5,054,503 | A | 10/1991 | Keller | |
| 5,065,778 | A | 11/1991 | Terrell | |
| 5,791,008 | A | 8/1998 | Crabtree | |
| 5,857,411 | A * | 1/1999 | Carsel | 101/333 |
| 5,915,746 | A * | 6/1999 | Melcher et al. | 29/450 |
| 6,305,047 | B1 | 10/2001 | Armaly | |
| 6,485,822 | B1 * | 11/2002 | Osiecki et al. | 428/316.6 |
| 2002/0117185 | A1 * | 8/2002 | Simon et al. | 134/6 |
| 2008/0155726 | A1 | 7/2008 | Anclien | |
| 2009/0276971 | A1 | 11/2009 | Nozari | |
| 2010/0037413 | A1 | 2/2010 | Tyler | |

FOREIGN PATENT DOCUMENTS

| | | | |
|---|---|---|---|
| CH | 688259 | * | 7/1997 |

* cited by examiner

*Primary Examiner* — Mark Spisich
(74) *Attorney, Agent, or Firm* — McDonnell Boehnen Hulbert & Berghoff LLP

(57) ABSTRACT

A sponge with a sponge body and at least one opening in the side surface or surfaces to receive one or more fingers and thumbs of a user. The at least one opening may be located along the perimeter of the sponge. The at least one opening is capable of providing protection to a user's fingernail, knuckles, and other parts of the finger, during use. The sponge body may be formed into any shape or size. Additionally, the openings may be dimensioned such that they are capable of receiving and protecting the fingers and thumbs of a user. The sponge body can be formed from any acceptable material, such as poly vinyl alcohol (PVA).

9 Claims, 3 Drawing Sheets

SPONGE WITH ONE OR MORE SURFACE OPENINGS

BACKGROUND

Unless otherwise indicated herein, the materials described in this section are not prior art to the claims in this application and are not admitted to be prior art by inclusion in this section.

A sponge is a common tool used for cleaning, absorbing, drying, filtering, and wiping activities. Sponges are generally constructed out of porous materials designed to effectively absorb liquid solutions. The porous materials consist of a network of interconnected fibers that create holes within the sponge body. When liquid is introduced to the sponge, the holes between the fibers may fill up causing the porous material to swell. The swelling action traps the liquid until active pressure is applied to the sponge, thus releasing the absorbed liquid.

Sponges have numerous applications and may be specifically designed to suit the needs of each specific application. In particular, sponges may be constructed out of a number of different porous materials. Examples may include natural sea sponge, cellulose, rubber sponge, viscose sponge, polyester sponge, polyurethane sponge, or polyvinyl alcohol sponge (PVA), among others. The porous material chosen may affect a sponge's durability, effectiveness, weight, and ability to absorb or retain liquid.

SUMMARY

In one aspect, a sponge may include: a sponge body, the sponge body comprising one or more side surfaces; and at least one of the one or more side surfaces comprising one or more openings.

In another aspect, a sponge may include: a sponge body, the sponge body comprising one or more side surfaces; and at least one of the one or more side surfaces comprising an opening.

In a further aspect, a sponge may include: a sponge body, the sponge body comprising one or more side surfaces; and at least one of the one or more side surfaces comprising six openings.

These as well as other aspects, advantages, and alternatives, will become apparent to those of ordinary skill in the art by reading the following detailed description, with reference where appropriate to the accompanying drawings.

DETAILED DESCRIPTION

Figure 1A:
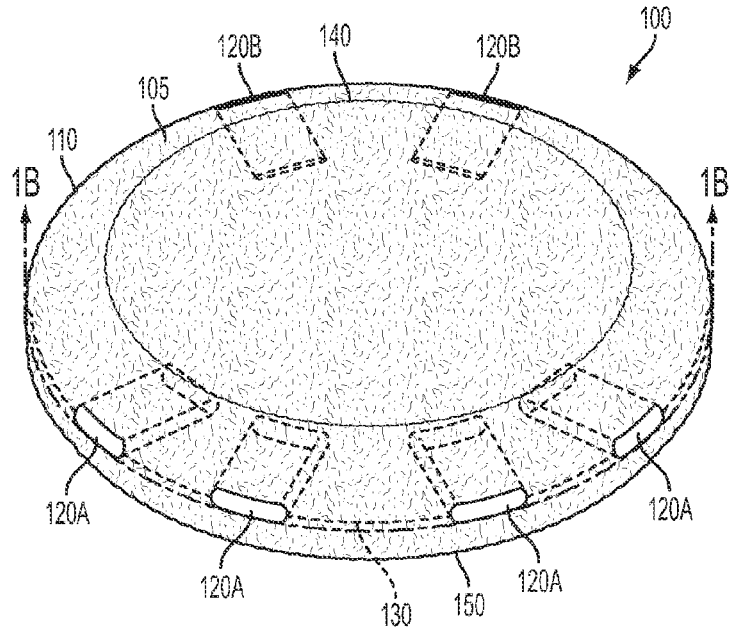
FIG. 1A shows a perspective view of a first example sponge.

FIG. 1A illustrates a perspective view of a sponge 100 according to an example embodiment. The sponge 100 may include a sponge body 105, side surfaces 110, openings 120*a* and 120*b*, *a* perimeter 130, a top surface 140, and a bottom surface 150. The openings 120*a* and 120*b* may be positioned along the perimeter 130 of the side surfaces 110 on the sponge body 105. Top surface 140 and bottom surface 150 may be located on the sponge body 105 and, in some example embodiments, may not contain any openings 120*a* and 120*b*.

The sponge body 105 may be formed in any of a number of different ways. For example, in some example embodiments, the sponge body may be molded. In other example embodiments, the sponge body may be cut, injection molded, molded by casting or foaming, extruded, or machined. Other examples are possible, as well. In addition, the method of construction may relate to or be determined by the material out of which the sponge is constructed.

Figure 1B:
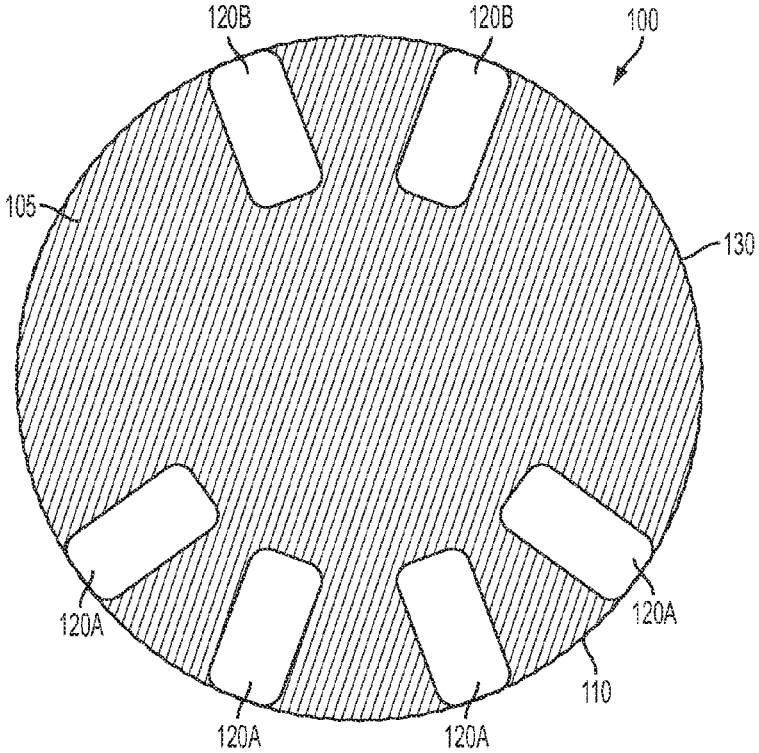
FIG. 1B shows a cross-sectional view of the example sponge of FIG. 1A.

The sponge body 105 may be formed into any of a number of different shapes. In some example embodiments, as illustrated in FIGS. 1A and 1B, the sponge body 105 may be constructed into a circular shape. Other shapes may be possible as well, including, but not limited to, oval, square, rectangular, triangular, semi-circular, or crescent. The shape may also be irregular or undefined, as well.

Additionally, sponges may be produced in many different sizes. For example, a sponge may be sized such that a user can grip the sponge in one hand. Alternatively, a sponge may be large enough to be affixed to a mop or sponge for cleaning purposes. Regardless, the number of different sizes and shapes is limitless.

The dimensions of each sponge 100, including the diameter, length, width, and thickness may also vary. For example, some sponges may be manufactured such that they can be held in one hand. In such examples, the dimensions of the sponge body 105 may match the size of, or be slightly larger than, a typical hand.

In other examples, the sponge 100 may be larger or smaller than the size of a typical hand. In some cases, the sponge may be used on small surfaces or in small spaces, such as bottles or jars, for example. In such cases, a sponge body 105 with smaller dimensions may be appropriate. In other cases, the sponge may be used on larger surfaces, such as on vehicles or on household surfaces such as counters, shelves, floors, walls, or ceilings. In such cases, a sponge body 105 with larger dimensions may be appropriate.

In yet other examples, the sponge 100 may be attached to a handle. In some cases, the sponge may be attached to the end of a very long handle, similar to a mop. Such sponges may also have a sponge body 105 with larger dimensions, especially if the sponge could be used on larger surfaces.

Other example uses and applications are possible as well. Moreover, the dimensions of the sponge 100 or sponge body 105 are not necessarily limited or determined by the sponge's use or application. For example, a sponge with dimensions that match the size of a typical hand may be used with a very long handle, and a handheld sponge may be used on larger surfaces, such as on vehicles, counters, shelves, floors, walls, or ceilings.

The sponge body 105 may contain a number of surfaces. According to the example embodiment illustrated in FIGS. 1A and 1B, the sponge body 105 may include one or more side surfaces 110, a top surface 140, and a bottom surface 150. Other surfaces may exist in alternative embodiments. Typically, all surfaces of a sponge may be porous, although in some examples some surfaces may not be porous. In addition, some surfaces may be more porous than others, and some surfaces may be made of different materials from others.

In an example embodiment, the side surfaces 110 may create a perimeter 130 around the sponge body 105. The perimeter 130 may be defined as a continuous line formed around the sponge body 105 by the side surfaces 110 to create a boundary of the sponge. As illustrated in the example embodiment in FIGS. 1A and 1B, the perimeter 130 may be located on one or more surfaces comprising the circumference of the sponge body 105. Alternatively, in other example embodiments, the perimeter 130 may be located on one or more surfaces comprising the length and width of the sponge.

The perimeter 130 may be centered on the side surfaces 110 or equidistant from the top surface 140 and the bottom surface 150 of the sponge body 105, or may alternatively be located closer to the top surface 140 or bottom surface 150. Additionally, the perimeter 130 may not be located at the same height throughout the same sponge body 105.

The side surfaces 110 may exist in various forms. For example, the surfaces may be rounded, angled, or straight. Additionally, the surfaces may vary in height and length depending on the preferred shape. In an example embodiment, the side surface 110 is rounded, allowing the sponge to have a circular shape. Alternatively, all of the surfaces may be straight, thus creating a square or rectangular shape.

The sponge 100 may be made out of any of a number of materials. In some examples, the sponge may be made from one material. In other examples, the sponge may be made from more than one material. If the sponge comprises multiple materials, the materials may all be porous or, in some cases, one or more materials may be porous and one or more materials may not be porous. The materials may also have varying degrees of porosity.

The sponge body 105 may be constructed from various types of porous materials. These materials may include, but are not limited to, natural sea sponge, polyvinyl alcohol (PVA), cellulose, viscose sponge, rubber latex (synthetic rubber), polyurethane sponge, polyethylene sponge, and polyester sponge. Other materials may be possible as well. The material of the sponge body 105 may impact additional sponge properties, such as ability to retain water, durability, absorption rate, and sponginess, which incorporates compressibility and elasticity.

In one example embodiment, the sponge body 105 may be constructed from polyvinyl alcohol (PVA). PVA can form a plastic porous structure that is made from water soluble PVA acetalized with an acid catalyst. Use of PVA may be advantageous because it resembles the properties and qualities of natural sea sponge. PVA may also have a high filtering efficiency and may be reusable after cleaning. It may also exhibit strong chemical resistance and can retain large amounts of liquids. PVA may also resist the growth of mold, mildew, and bacteria.

PVA may be manufactured to contain a variety of pore sizes—from very small pores to large pores similar to those of natural sea sponges. Pore size within the sponge body 105 may impact its ability to retain liquids. For example, a sponge body 105 with large pores may allow more liquid to flow through the sponge as compared to a sponge with small pores. In an example embodiment, pore size may range from 60 microns up to and including 1500 microns. Other pore size ranges may be possible as well.

In yet another embodiment, the sponge 100 may include an abrasive surface to aid in a cleaning process. For example, the sponge may include an abrasive or resin material, such as melamine. In one example, the abrasive or resin materials may be impregnated into the sponge body 105. In another example, the sponge may contain one or more layers of abrasive or resin on the surfaces of the sponge body 105. Such an abrasive or resin material may act to aid in the cleaning process by providing more friction against the surfaces engaged by the sponge or to be cleaned by the sponge. In addition, fine abrasives may be added to the PVA sponge. The abrasives can be absorbed by the PVA sponge and retained so that the PVA sponge itself becomes abrasive.

In other examples, the sponge may include a scouring surface (similar to a scouring pad). The scouring surface may be located on any surface of the sponge, and may provide additional assistance for cleaning purposes.

As illustrated in the embodiment in FIGS. 1A and 1B, the sponge body may include one or more openings 120*a* and 120*b*. One or more of the openings may receive, for example, a finger or thumb. In some embodiments, one or more of the openings may receive, for example, a handle or connection for a handle. Such a handle may be used to, for example, grip the sponge or extend the reach of the sponge.

The openings 120*a* and 120*b* may be located on the side surfaces 110 along the perimeter 130 of the sponge body 105. The number, shape, size, and location of the openings 120*a* and 120*b* may vary. The number of openings 120*a* and 120*b* may also vary. In some cases, the number of openings 120*a* and 120*b* may vary based on, for example, the dimensions of the sponge body 105.

In addition, the openings 120*a* and 120*b* may be in the form of slits, slots, holes, cuts, gaps, crevices, or indentations, for example, and may be formed into the sponge body 105 using various methods. The methods may include, but are not limited to, tooling, water jet cutting, drilling, molding, machining, cutting (with scissors, blades, or other manual or automated cutting implements), die cutting, laser cutting, or router cutting, for example.

The openings 120*a* and 120*b* may also be sized such that a user may place one or more digits, such as one or more fingers or thumbs, into the openings. In an example embodiment, the openings 120*a* and 120*b* may be approximately ¼ inch to 1¾ inch wide around the perimeter 130 of the sponge body 105. In other embodiments, the openings 120*a* and 120*b* may be larger or smaller, and may vary in size.

The number of openings 120*a* and 120*b* may vary. In the example embodiment depicted in FIGS. 1A and 1B, the sponge body 105 may contain six openings 120*a* and 120*b*. The six openings may include four "finger" openings 120*a*, and two "thumb" openings 120*b*. The two "thumb" openings 120*b* may generally oppose the four "finger" openings 120*a*. The six openings may allow a user holding the sponge 100 with one hand to place all four fingers into openings 120*a*, with two available openings 120*b* for a thumb.

Such "thumb" openings 120*b* can be oriented such that one "thumb" opening may more easily accommodate a thumb on the left hand, while the other "thumb" opening may more easily accommodate a thumb on the right hand. In particular, because a person's thumb is next to (or closest) to a person's index finger, a user's thumb may use whichever "thumb" opening 120*b* is closest to the opening used by that user's index finger.

In an example embodiment, each thumb opening 120*b* may be oriented approximately 112.5 degrees from the closest finger opening 120*a*. In other embodiments, each thumb opening 120*b* may be oriented in the range of 90 degrees to 120 degrees from the closest finger opening 120*a*. In some embodiments, the thumb openings may be oriented 45 degrees from each other. In other embodiments, each thumb opening 120*b* may be oriented in the range of 30 degrees to 90 degrees from each other. In some embodiments, the finger openings may be oriented 22.5 degrees from each other. In other embodiments, each finger opening 120*a* may be oriented in the range of 22.5 degrees to 45 degrees away from each other. Other distances any orientations may be possible as well.

In yet another example, each thumb opening 120*b* may be oriented on the same side surface 110. Likewise, each finger opening 120*a* may be oriented on the same side surface 110.

In an example embodiment, the side surface 110 comprising the thumb openings 120*b* may generally oppose the side surface 110 comprising the finger openings 120*a*.

In an alternative example embodiment, the openings 120*a* and 120*b* may be oriented such that they are spaced equally around the perimeter 130 of the sponge body 105. Further, in yet another embodiment, the openings 120*a* and 120*b* may be placed at varying distances from each other.

In an alternative embodiment, the sponge body 105 may contain a single opening that extends around a portion of the perimeter 130 or the entire perimeter 130.

In yet a further embodiment, the sponge body 105 may include a sufficient number of openings 120*a* and 120*b* such that a user may place fingers or thumbs from two hands into the sponge body 105. Such an embodiment may also have openings that comprise finger openings 120*a* and thumb openings 120*b*, and such openings may be on generally opposing surfaces, or may be oriented to more easily accommodate particular fingers and/or thumbs of a user, as discussed above.

The depth of the openings 120*a* and 120*b* may vary. In an example embodiment, the openings 120*a* and 120*b* may be tooled approximately ½ inch to 3 inches deep into the sponge body 105. The openings 120*a* and 120*b* may be sized such that a user may place a portion of one or more digits, such as one or more fingers or thumbs, into the openings. In other embodiments, the openings 120*a* and 120*b* may be sized such that a user may place one or more digits in their entirety into the openings. In further embodiments, the openings 120*a* and 120*b* may be larger or smaller, and may vary in size.

In one embodiment, the sponge body 105 may be sterilized using a variety of sterilization methods. The sterilization methods may include, but are not limited to, gaseous sterilization, exposure to ethylene oxide (EtO), chlorine or a sterilizing medical liquid, gamma radiation sterilization, autoclave, or exposure to ultraviolet lamps.

Further, the sponge body 105 may be impregnated with various types of liquid solutions. The liquid solutions may include an antibacterial solution, which may be used to prevent bacterial growth on the sponge. Alternatively, the solution may include soap, which may be used for cleaning purposes. Other possible liquid solutions may exist as well.

FIG. 1B illustrates a cross-sectional view of the sponge 100 according to the embodiment of the sponge constructed in accordance with FIG. 1A. The sponge 100 includes a sponge body 105, a side surface 110, openings 120*a* and 120*b* and a perimeter 130. As shown in this figure, the openings 120*a* and 120*b* are located within the sponge body 105 with access through the side surfaces 110. In FIG. 1B, the openings 120*a* and 120*b* are tooled to a depth that does not reach the center of the sponge. In alternative embodiments, however, the openings 120*a* and 120*b* may be at a depth that extends through the center of the sponge body 105.

Additionally, as depicted in FIG. 1B, the openings 120*a* and 120*b* may be oriented at different distances from one another. In an alternative embodiment, the openings 120*a* and 120*b* may be oriented equally around the perimeter 130 of the sponge body 105. As discussed above, the number of openings 120*a* and 120*b* may vary, ranging from one opening to as many openings as capable of fitting into the sponge.

Figure 2:
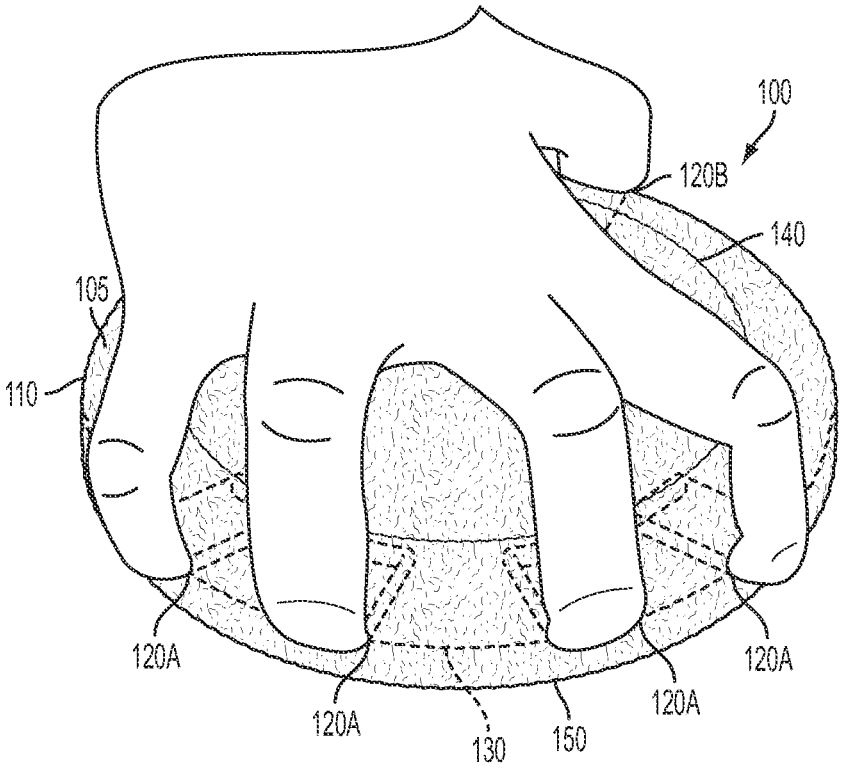
FIG. 2 shows a perspective view of the example sponge of FIGS. 1A and 1B in use.

FIG. 2 illustrates a perspective view of the sponge of FIGS. 1A and 1B in use. In operation, the openings 120*a* may receive one or more of the user's fingers. The openings 120*b* may receive one or more of the user's thumb or thumbs. When the openings 120*a* and 120*b* receive one or more of the user's fingers and thumbs, protection of the user's fingers or thumbs, fingernails, or knuckles may occur. The openings may assist the user's ability to clean tough surfaces, wring out the sponge, and more precisely direct the sponge while cleaning. As mentioned above, the user's fingers may fit into the individual openings 120*a* and 120*b* located on the sponge or into the one slit that spans the entire perimeter, as seen in FIG. 3.

Figure 3:
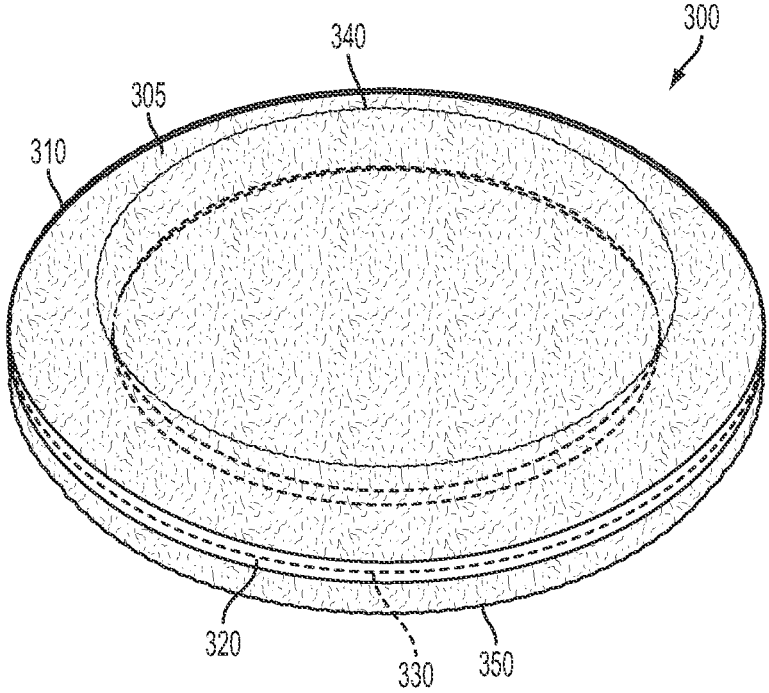
FIG. 3 shows a perspective view of a second example sponge.

FIG. 3 illustrates a perspective view of a sponge 300 according to an embodiment of the present invention. The sponge 300 includes a sponge body 305, side surfaces 310, an opening 320, a perimeter 330, a top surface 340, and a bottom surface 350. The opening 320 is positioned around the perimeter 330 of the side surfaces 310 on the sponge body 105. As can be seen in FIG. 3, the opening 320 may extend around the entire perimeter 330 of the sponge body 305. The continuous opening allows a user to place one or more fingers or thumbs into the sponge body 305 at any orientation of the sponge. In an alternative embodiment, the opening 320 may extend around a portion of the perimeter 330.

Additionally, while various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are contemplated herein.

I claim:

1. A sponge comprising:

a generally circular sponge body, the sponge body comprising substantially planar top and bottom surfaces and a peripheral side surface between the top and bottom surfaces;

a plurality of openings in the side surface which extend radially inward into the sponge body, the plurality of openings including a plurality of finger openings and at least one thumb opening disposed in the side surface such that it is substantially diametrically opposed to the finger openings;

wherein each of the openings have a generally oblong shape defined by a pair of long sides which are substantially parallel to the top and bottom surfaces, the height of each opening being substantially less than the length of the long sides thereof.

2. The sponge according to claim 1, wherein the openings comprise a depth dimension of at least one half of an inch.

3. The sponge according to claim 1, wherein the peripheral side surface comprises a total of six openings.

4. The sponge according to claim 3, wherein the total of six openings comprises four finger openings and two thumb openings.

5. The sponge according to claim 4, wherein the two thumb openings comprise a first thumb opening and a second thumb opening, and wherein the first thumb opening and the second thumb opening are closer to each other than to any one of the four finger openings.

6. The sponge according to claim 4, wherein the four finger openings comprise a first finger opening, a second finger opening, a third finger opening, and a fourth finger opening, and wherein the first finger opening, the second finger opening, the third finger opening, and the fourth finger opening are closer to each other than to any one of the two thumb openings.

7. The sponge according to claim 1, wherein the sponge body has a pore size ranging from approximately 60 microns to approximately 1500 microns.

8. The sponge according to claim 1, wherein the top surface and the bottom surface are substantially parallel.

9. The sponge according to claim 8, wherein the openings are aligned along a plane, and the plane is substantially parallel to the top surface and the bottom surface.

* * * * *